US005632325A

United States Patent [19]

Fischer et al.

[11] Patent Number: 5,632,325

[45] Date of Patent: May 27, 1997

[54] PROCESS AND APPARATUS FOR STRAND-CASTING NEAR FINAL SIZE CAST FORMATS

[75] Inventors: Eberhard Fischer, Bütthard; Helmut Maag, Waldbüttelbrunn; Erling Roller, Essen, all of Germany

[73] Assignee: Mannesmann Aktiengesellschaft, Dusseldorf, Germany

[21] Appl. No.: 453,101

[22] Filed: May 30, 1995

[30] Foreign Application Priority Data

May 30, 1994 [DE] Germany ..... 44 19 387.4

[51] Int. Cl.[6] ..... B22D 11/04; B22D 11/12; B22D 11/126

[52] U.S. Cl. ..... 164/477; 164/478; 164/416; 164/476; 164/417; 164/460; 164/263; 164/462

[58] Field of Search ..... 164/477, 476, 164/417, 460, 462, 463, 478, 416, 263; 29/527.6, 527.7

[56] References Cited

U.S. PATENT DOCUMENTS 4,598,761 7/1986 Ishihara et al. ..... 164/460
5,211,217 5/1993 Morii et al. ..... 164/417

FOREIGN PATENT DOCUMENTS 0203867 7/1990 European Pat. Off. .
42-1724 1/1967 Japan ..... 164/477

*Primary Examiner*—Joseph J. Hail, III
*Assistant Examiner*—I.-H. Lin
*Attorney, Agent, or Firm*—Cohen, Pontani, Lieberman, Pavane

[57] ABSTRACT

A process and an apparatus for strand-casting near to final size cast formats from non-ferrous metals for the purpose of further cold working, especially strips, bars or tubes of copper or copper alloys. The process includes continuously casting the melt in a vertical mold to form a vertical strand, withdrawing the solidified strand from the mold in a centrally guided manner and directly threading into a surface treatment machine, removing the surface of the strand, laterally cutting the surface-finished strand in a predetermined manner, and removing the cut strand pieces from the machine. The machine for carrying out the process has a base frame which is connected to a foundation and on which a withdrawal device, a surface treatment unit, a cross-cutting device, and a conveying device are provided in line.

13 Claims, 1 Drawing Sheet

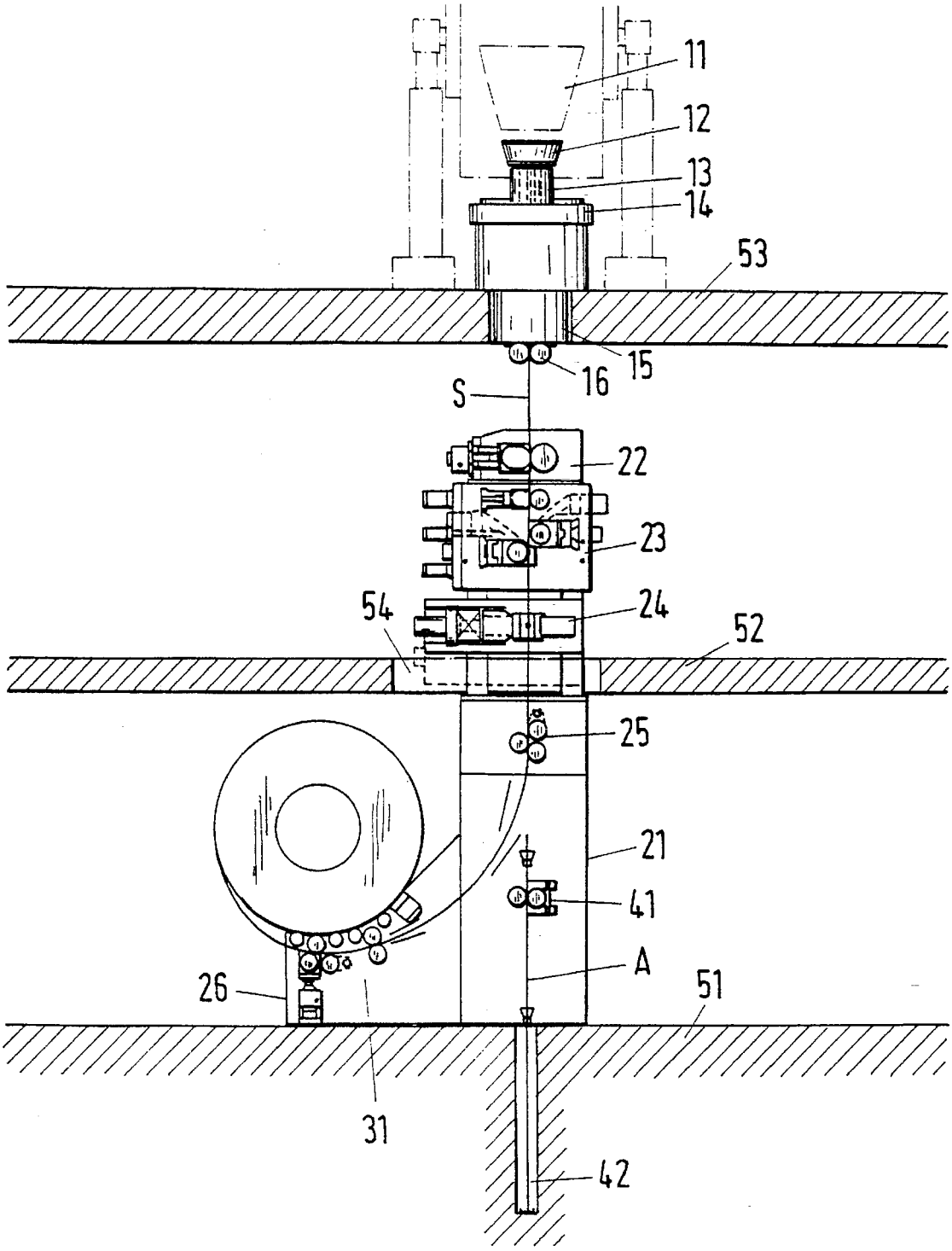
11
12
13
14
53
15
16
S
22
23
24
54
52
25
21
41
A
26
51
31
42

PROCESS AND APPARATUS FOR STRAND-CASTING NEAR FINAL SIZE CAST FORMATS

BACKGROUND OF THE INVENTION

1. Field of the Invention

The invention relates to a process for strand-casting non-ferrous metals to form cast formats near to final size for the purpose of further cold working. The invention more particularly relates to casting of strips, bars or tubes of copper or copper alloys.

2. Discussion of the Prior Art

In vertical or horizontal strand-casting machines, various cast formats, such as strips, bars and tubes, are continuously cast. In such a process, the molten metal is fed to a cooled mold, which extracts the heat from the metal and allows a solid strand shell to develop.

A device for strand-casting metal products is known from EP 0203867. In this device the molten metal is fed from a casting ladle to a continuously-fed mold and from there to a withdrawal and secondary cooling device. After full solidification, the finished strip is diverted and coiled around a coiler. This known device does not have any means for treating the surface of the strip or for cross-cutting. In horizontal strand-casting machines for non-ferrous metals, the use of milling machines to, for example, machine the strips, and the use of free-floating shears to cross-cut the strips is known.

SUMMARY OF THE INVENTION

The object of the invention is to create a process and an apparatus for the continuous casting of any desired shape, in which continuously cast strands of copper or copper alloys are brought to the output quality and output formats desired for subsequent cold working. This is to be accomplished using structurally simple means and with a minimum of metal losses.

Pursuant to this object, and others which will become apparent hereafter, one aspect of the present invention resides in a process for strand-casting near final size cast formats from non-ferrous metals, which process includes continuously casting a melt in a vertical mold to form a solidified strand and subsequently withdrawing the solidified strand from the vertical mold in a centrally guided manner and directly threading the strand into a surface treatment machine. The surface of the strand is then removed and the strand is laterally cut into pieces. Subsequently, the cut pieces of strand are removed from the machine.

A further embodiment of the inventive process includes bending and coiling the strand prior to removing the strand from the strand-casting machine. It is desirable to have the cross cutting of the strand take place upon reaching predetermined coil weight.

A further embodiment of the inventive process includes removing the surface of the strand to a depth that is less than 5% of the strand thickness. The removing of the strand surface is carried out mechanically by either milling or peeling. The construction of milling or peeling devices for carrying out this mechanical removal of the strand surface is known by those in the art.

A further aspect of the present invention resides in an apparatus for vertically casting near final size cast formats from non-ferrous steels, which apparatus includes a distributor that is connected to a pouring basin which in turn is attached to a vertically arranged mold. The apparatus further includes a base frame connectable to a foundation and on which withdrawal means are mounted for withdrawing the solidified strand from the mold in a withdrawal direction. Surface treating means are mounted on the base frame for treating the surface of the solidified strand drawn from the mold. Cross-cutting means are also mounted on the base frame for cross-cutting the surface treated strand. Additionally, conveying means for conveying the cross-cut strand are also mounted on the base frame. All of these components are arranged on the base frame consecutively, in line in the strand withdrawal direction.

According to the invention, the strip is strand-cast in a vertical position, whereby the strip, after its solidification, is withdrawn in a centered manner and threaded directly into a surface treatment machine. Because the strand emerging vertically from the mold is guided in a precise manner, the use of a threading machine is not required. Furthermore, in a machine which has an oscillating mold and continuous strand movement, no special devices are needed to adjust the surface treatment machine to the strand movement. Because vertical casting with an oscillating mold avoids drawing marks which occur in stationary molds as well as the segregation which, to a slight extent, influences the strip surface, only a small quantity of surface material must be removed.

An especially segregation-free product is produced with the use of a vertical mold oscillated at a high frequency and of linear strand withdrawal speed.

The strip, which is free of defects after removal of the surface material, can then be processed as desired, for example, bent and then coiled immediately thereafter. This process is particularly important in the strand-casting of alloys which have a tendency to segregate, especially tin-bronzes or phosphorus-deoxidized copper. For example, tin-bronzes may, because of tin concentrations, display brittle phases on the strand surface that lead to the formation of surface cracks. If, for example, such a strip is bent without pretreatment, these cracks intensify because the surface cracks on the outer side of the bent strip become deeper, while the cracks on the inner side are initially compressed and, upon subsequently being bent back, become especially wide because of the previous compression.

According to the invention, the brittle phase is done away with by the surface removal while still in the vertical region of the strip, so that the strip can subsequently be worked as desired. Along with the improvement in strip quality, the reduction in mechanical machining increases yield, among other things, and the avoidance of surface defects significantly expands the production program. The machine according to the invention requires only one base frame connected to the foundation, on which the drawing device, the machining device, the cutting device and, as applicable, the strip diversion device are arranged. In this way, the usually relatively high investment costs for a vertical machine are distinctly reduced.

If the surface treatment machine is installed after and horizontally to the band diversion device, then an extremely expensive strip reverse-bending and straightening machine will be needed in order to thread the strip precisely into the surface treatment device. The surface treatment machine can be a metal cutting machine such as a milling or peeling machine.

A particular advantage is obtained by arranging a container directly below the cross-cutting device in the strand withdrawal direction, because this permits the production of especially bend-sensitive material.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

The single figure is an elevation of the strand-casting machine pursuant to the present invention.

DETAILED DESCRIPTION OF THE PRESENTLY PREFERRED EMBODIMENTS

The figure shows casting equipment arranged on a casting floor 53. The casting equipment consists of a distributor 11, a hot-top 12, and a mold 13. This mold 13 is connected to a oscillation drive 14 that includes secondary cooling and is arranged above a cascade water junction 15, on which guide rollers 16 are provided.

A strand S is withdrawn downwardly from the casting equipment in a vertical direction by a withdrawal device 22. The withdrawal device 22 is followed in the strip guidance direction by a surface treatment machine 23, which is a milling machine in the illustrated embodiment, and by a cutting device 24, here provided as shears. Both the milling machine 23 and the shears 24 are arranged on a base frame 21 that is connected to the foundation 51 of the steel making plant.

The withdrawal device 22, the surface treatment machine 23 and the cutting device 24 are accessible from a working platform 52, which has an opening 54 that permits the connection of the withdrawal device 22, the surface treatment machine 23 and the cutting device 24 to the base frame 21. The base frame 21 also accommodates a conveying and bending device 25 and a separate conveying device 41.

The bending device 25 diverts the conveyance direction of the strand S and feeds the strand to a strip coiler or strip curling machine 31 arranged on a base frame part 26. When the bending device 25 is opened or omitted, the strand S or a starting bar A is fed from the conveying device 41 to a container 42 provided in the steel plant foundation 51. As described above, by closing the bending device 25, the strand S itself can be diverted and fed to a strip coiler or curling machine 31.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A process for strand-casting near final size cast formats from non-ferrous metals, for further cold working, comprising the steps of: continuously casting a melt in a vertical mold to form a solidified strand; oscillating the vertical mold at high frequency; withdrawing the solidified strand downward from the vertical mold in a centrally guided manner at a uniform speed; directly threading the strand into a surface treatment machine; mechanically removing a surface of the strand to remove defects; bending and coiling the strand; weighing the coiled strand; laterally cutting the strand into pieces in a preset manner upon reaching a predetermined coil weight; and removing the cut strand pieces from the machine.

2. A process as defined in claim 1, wherein the surface removing step includes removing the surface to a depth that is less than 5% of strand thickness.

3. A process as defined in claim 1, wherein the surface removing step includes milling the surface of the strand.

4. A process as defined in claim 1, wherein the surface removing step includes peeling the surface of the strand.

5. An apparatus for vertically casting near final size cast formats from non-ferrous metals for further cold working, comprising: a vertically arranged mold; a base frame; withdrawal means, mounted on the base frame, for withdrawing a solidified strand from the mold in a withdrawal direction; surface treating means including a metal cutting machine, mounted on the base frame, for treating the surface of the solidified strand drawn from the mold; cross-cutting means, mounted on the base frame, for cross-cutting the surface treated strand; conveying means, mounted on the base frame, for conveying the cross-cut strand, the withdrawal means, the surface treating means, the cross-cutting means, and the conveying means being arranged on the base frame consecutively, in line in the strand withdrawal direction; a distributor and a pouring basin, the mold being attached to the pouring basin; and oscillating drive means connected to the mold for oscillating the mold.

6. An apparatus as defined in claim 5, wherein the metal-cutting machine is a milling machine.

7. An apparatus as defined in claim 5, wherein the metal-cutting machine is a peeling machine.

8. An apparatus as defined in claim 5, wherein the cross-cutting means includes a mechanical cutting device.

9. An apparatus as defined in claim 8, wherein the mechanical cutting device includes shears.

10. An apparatus as defined in claim 5, and further comprising a receptacle provided subsequent to the cross-cutting means and the conveying means in the strand withdrawal direction.

11. An apparatus as defined in claim 5, wherein the conveying means provided after the cross-cutting means in the strand withdrawal direction includes a conveyor and bending device, and further comprising strand coiling means for coiling the strand after the strand leaves the conveyor and bending device, the conveyor and bending device being operative to direct the strand toward the strand coiling means.

12. An apparatus as defined in claim 11, wherein the conveying means further includes a conveyor device in addition to the conveyor and bending device and arranged in line in the strand withdrawal direction, the conveyor and bending device and the additional conveyor device being adapted to accept a starting bar.

13. An apparatus as defined in claim 5, wherein the base frame is mountable to a foundation.

* * * * *